US006723137B1

(12) United States Patent
Hakamada et al.

(10) Patent No.: US 6,723,137 B1
(45) Date of Patent: Apr. 20, 2004

(54) PRINTING PROCESS, PRINT OBTAINED BY THE PROCESS AND PROCESSED ARTICLE

(75) Inventors: Shinichi Hakamada, Kawasaki (JP); Shoji Koike, Yokohama (JP); Koromo Shirota, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 09/672,818

(22) Filed: Sep. 29, 2000

(30) Foreign Application Priority Data

Oct. 1, 1999 (JP) ..... 11-282066

(51) Int. Cl.[7] ..... D06T 5/30

(52) U.S. Cl. ..... 8/549; 8/543; 8/499; 8/445; 8/641

(58) Field of Search ..... 8/494, 641, 549, 8/445, 466; 347/101, 641

(56) References Cited

U.S. PATENT DOCUMENTS

| | | | | |
|---|---|---|---|---|
| 4,557,761 | A | 12/1985 | Kobayashi et al. | 106/22 |
| 4,632,703 | A | 12/1986 | Koike et al. | 106/22 |
| 4,661,158 | A | 4/1987 | Kobayashi et al. | 106/22 |
| 4,689,078 | A | 8/1987 | Koike et al. | 106/22 |
| 4,702,742 | A | 10/1987 | Iwata et al. | 8/495 |
| 4,725,849 | A | 2/1988 | Koike et al. | 346/1.1 |
| 4,804,411 | A | 2/1989 | Eida et al. | 106/22 |
| 4,838,938 | A | 6/1989 | Tomida et al. | 106/22 |
| 4,849,770 | A | 7/1989 | Koike et al. | 346/1.1 |
| 4,853,036 | A | 8/1989 | Koike et al. | 106/20 |
| 4,864,324 | A | 9/1989 | Shirota et al. | 346/1.1 |
| 4,923,515 | A | 5/1990 | Koike et al. | 106/22 |
| 4,957,553 | A | 9/1990 | Koike et al. | 106/20 |
| 4,965,612 | A | 10/1990 | Sakaki et al. | 346/1.1 |
| 4,969,951 | A | 11/1990 | Koike et al. | 106/22 |
| 5,017,227 | A | 5/1991 | Koike et al. | 106/22 |
| 5,053,078 | A | 10/1991 | Koike et al. | 106/22 |
| 5,059,246 | A | 10/1991 | Yamamoto et al. | 106/22 |
| 5,067,980 | A | 11/1991 | Koike et al. | 106/22 |
| 5,074,914 | A | 12/1991 | Shirota et al. | 106/22 |
| 5,075,699 | A | 12/1991 | Koike et al. | 346/1.1 |
| 5,081,470 | A | 1/1992 | Kurabayashi et al. | 346/1.1 |
| 5,099,255 | A | 3/1992 | Koike et al. | 346/1.1 |
| 5,101,217 | A | 3/1992 | Iwata et al. | 346/1.1 |
| 5,110,356 | A | 5/1992 | Shirota et al. | 106/22 |
| 5,118,351 | A | 6/1992 | Shirota et al. | 106/22 |
| 5,123,960 | A | 6/1992 | Shirota et al. | 106/22 |
| 5,124,201 | A | 6/1992 | Kurabayashi et al. | 428/323 |
| 5,124,718 | A | 6/1992 | Koike et al. | 346/1.1 |
| 5,135,570 | A | 8/1992 | Eida et al. | 106/22 |
| 5,135,571 | A | 8/1992 | Shirota et al. | 106/22 |
| 5,137,778 | A | 8/1992 | Nakatsugawa et al. | 428/330 |
| 5,139,573 | A | 8/1992 | Yamamoto et al. | 106/22 |

(List continued on next page.)

FOREIGN PATENT DOCUMENTS

| | | | |
|---|---|---|---|
| EP | 617161 | * | 9/1994 |
| JP | 2-73870 | * | 3/1990 |
| JP | 2-202956 | * | 8/1990 |
| JP | 54-59936 | | 5/1996 |
| JP | 8-127730 | | 5/1996 |
| KR | 161998 | | 1/1999 |

*Primary Examiner*—Margaret Einsmann
(74) *Attorney, Agent, or Firm*—Fitzpatrick, Cella, Harper & Scinto

(57) ABSTRACT

Disclosed herein is a textile printing process for dyeing a cloth black, the cloth comprising fibers dyeable with reactive dyes, the process comprising at least three steps of, (a) applying a black ink containing a black reactive dye and an orange ink containing an orange reactive dye to the cloth so as to at least partialy overlap each other by an ink-jet system, (b) heating or steaming the cloth, to which the inks have been applied in the step (a), and (c) washing the cloth resulted from the step (b), wherein the black and orange reactive dyes have reactive groups different from each other.

10 Claims, 3 Drawing Sheets

U.S. PATENT DOCUMENTS 5,141,558 A 8/1992 Shirota et al. ..... 106/22
5,151,128 A 9/1992 Fukushima et al. ..... 106/20
5,171,626 A 12/1992 Nagamine et al. ..... 428/212
5,190,581 A 3/1993 Fukushima et al. ..... 106/20
5,216,437 A 6/1993 Yamamoto et al. ..... 346/1.1
5,220,347 A 6/1993 Fukushima et al. ..... 346/1.1
5,221,333 A 6/1993 Shirota et al. ..... 106/20
5,231,417 A 7/1993 Shirota et al. ..... 346/1.1
5,246,774 A 9/1993 Sakaki et al. ..... 428/323
5,248,991 A 9/1993 Shirota et al. ..... 346/1.1
5,250,121 A 10/1993 Yamamoto et al. ..... 106/22
5,254,157 A 10/1993 Koike et al. ..... 106/20
5,257,036 A 10/1993 Koike et al. ..... 346/1.1
5,258,066 A 11/1993 Kobayashi et al. ..... 106/22
5,277,962 A 1/1994 Nakatsugawa et al. ..... 428/206
5,296,022 A 3/1994 Kobayashi et al. ..... 106/20
5,329,305 A 7/1994 Fukushima et al. ..... 347/95
5,358,558 A 10/1994 Yamamoto et al. ..... 106/22
5,362,558 A 11/1994 Sakaki et al. ..... 428/323
5,380,358 A 1/1995 Aoki et al. ..... 106/20
5,396,275 A 3/1995 Koike et al. ..... 347/101
5,415,686 A 5/1995 Kurabayashi et al. ..... 106/26
5,427,611 A 6/1995 Shirota et al. ..... 106/22
5,439,515 A 8/1995 Kurabayashi et al. ..... 106/20
5,468,553 A 11/1995 Koike et al. ..... 428/224
5,494,733 A 2/1996 Koike et al. ..... 428/224
5,500,023 A 3/1996 Koike et al. ..... 8/499
5,515,093 A 5/1996 Haruta et al. ..... 347/101
5,526,031 A 6/1996 Kurabayashi ..... 347/105
5,540,764 A 7/1996 Haruta et al. ..... 106/20
5,549,740 A 8/1996 Takahashi et al. ..... 106/20
5,593,757 A 1/1997 Kashiwazaki et al. ..... 428/195
5,594,485 A 1/1997 Koike et al. ..... 347/101
5,606,356 A 2/1997 Noguchi et al. ..... 347/100
5,614,007 A 3/1997 Kurabayashi et al. ..... 106/22
5,618,338 A 4/1997 Kurabayashi et al. ..... 106/26
5,621,447 A 4/1997 Takizawa et al. ..... 347/88
5,623,294 A 4/1997 Takizawa et al. ..... 347/98
5,624,484 A 4/1997 Takahashi et al. ..... 106/31.75
5,640,187 A 6/1997 Kashiwazaki et al. ..... 347/101
5,645,631 A 7/1997 Koike et al. ..... 106/31.36
5,651,814 A 7/1997 Shimomura et al. ..... 106/31.36
5,658,376 A 8/1997 Noguchi et al. ..... 106/31.43
5,680,165 A 10/1997 Takizawa et al. ..... 347/88
5,686,951 A 11/1997 Koike et al. ..... 347/106
5,690,698 A * 11/1997 von der Eltz et al.
5,696,182 A 12/1997 Kashiwazaki et al. ..... 523/161
5,698,478 A 12/1997 Yamamoto et al. ..... 442/153
5,700,314 A 12/1997 Kurbayashi et al. ..... 106/31.27
5,718,793 A 2/1998 Inamoto et al. ..... 156/235
5,734,403 A 3/1998 Suga et al. ..... 347/101
5,764,261 A 6/1998 Koike et al. ..... 347/100
5,781,216 A 7/1998 Haruta et al. ..... 347/106
5,782,967 A 7/1998 Shirota et al. ..... 106/31.58
5,792,249 A 8/1998 Shirota et al. ..... 106/31.27
5,835,116 A 11/1998 Sato et al. ..... 347/98
5,902,387 A 5/1999 Suzuki et al. ..... 106/22
5,922,625 A 7/1999 Haruta et al. ..... 442/75
5,985,975 A 11/1999 Kurabayashi et al. ..... 524/462
6,027,210 A 2/2000 Kurabayashi et al. ..... 347/100
6,033,066 A 3/2000 Koike et al. ..... 347/101
6,036,307 A 3/2000 Hakamada et al. ..... 347/106
6,084,006 A 7/2000 Kashiwazaki et al. ..... 523/160
6,284,348 B1 9/2001 Suzuki et al. ..... 428/195

* cited by examiner

PRINTING PROCESS, PRINT OBTAINED BY THE PROCESS AND PROCESSED ARTICLE

BACKGROUND OF THE INVENTION

1. Field of the Invention

The present invention relates to a process for conducting textile printing for dyeing a cloth black by an ink-jet system, a print obtained by such a process, and a processed article.

2. Related Background Art

At present, textile printing is principally conducted by screen printing or roller printing. Both methods are however undesirable to produce a variety of items in a small quantity and difficult to quickly cope with the fashion of the day. Therefore, there has recently been a demand for establishment of an electronic printing system making no use of any plates. In compliance with this demand, a great number of printing processes, to which an ink-jet system is applied, have been proposed. Various fields expect much of such printing processes.

Technical requirements for the printing processes, to which an ink-jet system is applied, include:

(1) to apply coloring matter to a cloth at a sufficient concentration for coloring;

(2) to give a high coloring yield of coloring matter to a cloth and an easy waste water treatment after a washing step;

(3) to alleviate irregular bleeding due to color mixing between inks of different colors on a cloth;

(4) to provide prints with wide color reproductivity; and (5) to produce prints with stable coloring ability.

Among these, the item (1) has been very difficult to solve because the absolute quantity of dyes able to be applied to a cloth in the printing processes, to which an ink-jet system is applied, is less than that in the conventional printing processes. In order to meet this requirement, there have heretofore been mainly made such countermeasures that a concentration of a dye in an ink is enhanced, and a cloth is subjected to a pretreatment. With respect to images of high saturation, coloring comparable to the conventional printing processes has been achieved by these efforts.

However, a problem has yet remained in the expression of "complete black color" in the ink-jet textile processes.

Such a problem has been generally managed by experienced color matching. In the ink-jet textile printing also, for example, Japanese Patent Application Laid-Open No. 8-127730 discloses that the combination of a specified black reactive dye (C.I. Reactive Black 5) and a specified yellow, orange or red reactive dye is preferred from the viewpoints of ink properties and the tint of black.

The present inventors have revealed that all the combinations disclosed in this publication are unified to only dyes having a vinylsulfone group as a reactive group to cloths. The unification of the kinds of reactive groups is certainly meaningful because no time lag is caused in the reactions with a cloth, and so reaction conditions can be unified. However, when coloring materials of black and orange are contained in the same ink as described above, there is involved a problem that such an ink cannot be used for a variety of cloths because the added proportions of these coloring materials cannot be changed. More specifically, since the degree of scattering of light on the surface of a cloth and the feeling thereof are different with cloths, the added proportions of the coloring materials of black and orange for obtaining far excellent "complete black color" vary with the cloths. For example, the proportions of the coloring materials of black and orange for cellulose must be naturally changed from those for silk. Further, since a water content in a cloth varies with the season and the like, and so a coloring yield to the cloth, and the like naturally vary, the contents of the coloring materials must be changed. However, it is not preferable from the viewpoints of cost and practical use to provide inks according to the type and condition of a cloth.

Therefore, the present inventors have investigated as to the color matching of black in textile prints by applying a black ink containing C.I. Reactive Black 5 and an orange ink containing a reactive dye having a monochlorotriazinyl group as a reactive group so as to partialy overlap each other.

Since reactive dyes used in inks are selected in consideration of not only the color-fixing property to a cloth, but also durability after color fixing, the types of reactive groups of reactive dyes contained in a black ink are not always unified. However, It is not generally preferable to use reactive dyes respectively having reactive groups different from each other in textile printing, and particularly, it has not yet been known to use reactive dyes respectively having reactive groups different from each other in color matching of black for textile prints. Under such circumstances, the present inventors have carried out a further investigation. As a result, it has been found that two types of reactive dyes, which respectively have reactive groups different from each other, i.e., exhibit different reactivities to a cloth, can improve the tint of black in textile prints, thus leading to completion of the present invention.

SUMMARY OF THE INVENTION

It is therefore an object of the present invention to solve such problems involved in the conventional ink-jet printing processes as described above when textile printing is conducted on a cloth composed mainly of fiber dyeable with reactive dyes by an ink-jet system, and particularly to provide an ink-jet printing process which can stably provide a high-density print of an achromatic black color even when the type and condition of a cloth, or conditions for a dyeing treatment by heating somewhat vary, together with a textile print obtained by such a process and a processed article.

The above object can be achieved by the present invention described below.

According to an embodiment of the present invention, there is thus provided a textile printing process for dyeing a cloth black, the cloth comprising fibers dyeable with reactive dyes, the process comprising at least three steps of:

(a) applying a black ink containing a black reactive dye and an orange ink containing an orange reactive dye to the cloth so as to at least partialy overlap each other by an ink-jet system;

(b) heating or steaming the cloth, to which the inks have been applied in the step (a); and (c) washing the cloth resulted from the step (b), wherein the black and orange reactive dyes have reactive groups different from each other.

According to an embodiment of the present invention, there is also provided a print obtained in accordance with the textile printing process described above.

According to another embodiment of the present invention, there is further provided a print dyed with black and orange dyes in a state at least overlapped, wherein the balck dye comprises at least one selected from the group consisting of C.I. Reactive Black 5, 14 and 31, and the orange dye comprises at least one dye selected from the group consisting of C.I. Reactive Orange 5, 12, 13 and 35.

According to an embodiment of the present invention, there is still further provided a processed article obtained by processing the print described above.

According to another embodiment of the present invention, there is yet still further provided a processed article obtained by cutting out the print described above into pieces of prescribed sizes and processing at least one of the pieces.

The present inventors have carried out an investigation for satisfying the above-described requirements for performance as to the ink-jet printing processes at the same time. As a result, it has been found that the expression of an achromatic black color can be stably achieved by separately applying a black and orange inks with the proportion of the black and orange dyes contained therein varied even when conditions for a fixing treatment are changed according to the types and conditions of cloths, so that the range of selection as to dyes to be combined can be widened.

As a reactive dye capable of achieving a deep black color, is preferred a dye having an azo group as a chromophore. In the case of the reactive dye, however, a limitation is imposed on the molecular structure of the dye because an unreacted dye must be washed out. Such a black reactive dye may often develop a color tone of navy blue by itself. When an orange reactive dye is shot herein, a print of an achromatic black color can be provided.

When the black reactive dye and the orange reactive dye are shot in a proportion of 1:2 to 8:1 in terms of a weight ratio of the black reactive dye to the orange reactive dye, a high-density print of an achromatic black color can be provided.

A limitation is imposed on the greatest amount of a dye contained in an ink for satisfying the viscosity and resistance to clogging in an ink for ink-jet printing. According to the process of the present invention, however, a black dye can be contained in an ink to the greatest amount over which the limitation is imposed.

DESCRIPTION OF THE PREFERRED EMBODIMENTS

Figure 1:
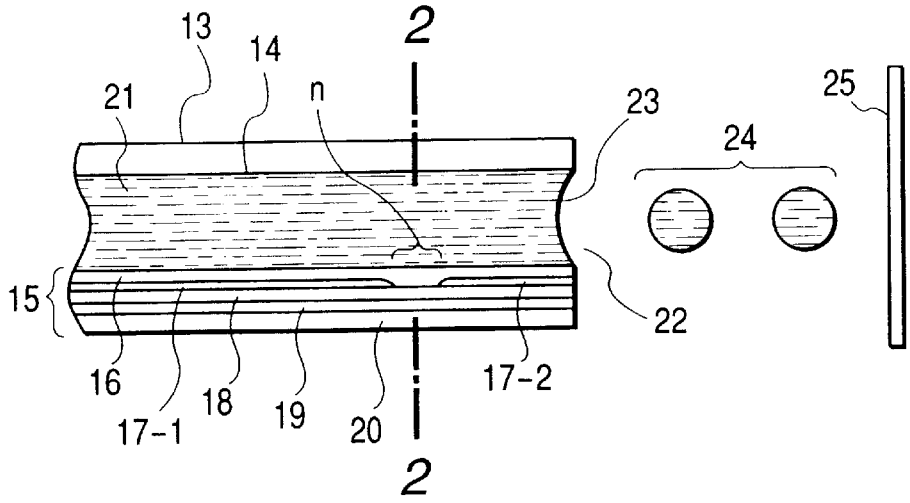
FIG. 1 is a longitudinal cross-sectional view of a head of an ink-jet printing apparatus.

The present invention will hereinafter be described in detail by preferred embodiments of the invention.

The inks used in the printing process of the present invention are inks for ink-jet printing, which comprise a black or orange reactive dye and an aqueous liquid medium. No particular limitation is imposed on the respective reactive dyes so far as they are composed of a combination of a black dye and an orange dye which respectively have reactive groups different from each other. However, a combination of a black reactive dye having a vinylsulfone group and an orange reactive dye having a monochlorotriazinyl group is preferred. The black reactive dye having the vinylsulfone group is preferably at least one dye selected from the group consisting of C.I. Reactive Black 5, 14 and 31, and the orange reactive dye having the monochlorotriazinyl group is preferably at least one dye selected from the group consisting of C.I. Reactive Orange 5, 12, 13 and 35.

The most preferable black reactive dye is C.I. Reactive Black 5, and the most preferable orange reactive dye is C.I. Reactive Orange 5, C.I. Reactive Orange 12 or C.I. Reactive Orange 13. When these specified dyes are used in combination, association or the like of the dyes on a cloth is hard to occur, and so an stable image can be provided even when conditions for dyeing treatment, such as the amount of steam and temperature, somewhat vary upon coloring of the dyes by a high-temperature steaming (HT steaming) process.

When C.I. Reactive Black 5 is used as the black reactive dye, the effect of the present invention is more markedly brought about when a monovinylsulfone form is contained in this dye at a content of 5 to 10% by weight based on a sulfatoethylsulfone form, since such an association-preventing effect as described above is exhibited to the maximum.

In order to satisfactorily retain the shelf stability of the ink, prevent ejection failure due to the viscosity increase or deposition of the ink and achieve a sufficient color density, the content (total content when at least two dyes are used in combination) of the reactive dye in the ink is within the range of preferably from 1 to 25% by weight, more preferably from 5 to 20% by weight, still more preferably from 8 to 15% by weight based on the total weight of the ink.

Incidentally, the orange ink referred to in the present invention means that classified as YR (yellowish red) when a color after dyeing a cloth with the ink is evaluated by comparison with a standard color chip in accordance with JIS Z 8721.

The print of a black color means that having L* of at most 20, a* of 0 to 4 and b* of −7.5 to 0 when the L*, a* and b* of the print are measured by a spectrocolorimeter. A more preferable print of a "complete black color" means that having L* of at most 18, a* of 0 to 3 and b* of −3 to 0.

The components other than the dye in the inks used in the present invention will hereinafter be described. The inks used in the present invention are prepared by dissolving or dispersing the respective dyes in an aqueous liquid medium composed mainly of water. Water is contained within the range of preferably from 10 to 93% by weight, more preferably from 25 to 87% by weight, still more preferably from 30 to 82% by weight based on the total weight of each ink. The effect of the present invention may also be made more marked by using a water-soluble organic solvent. Examples of such a water-soluble organic solvent include monohydric alcohols such as methanol, ethanol and isopropanol; ketones and ketone alcohols such as acetone and diacetone alcohol; ethers such as tetrahydrofuran and dioxane; addition polymers of oxyethylene or oxypropylene, such as diethylene glycol, triethylene glycol, tetraethylene glycol, dipropylene glycol, tripropylene glycol, polyethylene glycol and polypropylene glycol; alkylene glycols the alkylene moiety of which has 2 to 6 carbon atoms, such as ethylene glycol, propylene glycol, trimethylene glycol, butylene glycol and hexylene glycol; triols such as 1,2,6-hexanetriol; thiodiglycol; bishydroxyethyl-sulfone; glycerol; lower alkyl ethers of polyhydric alcohols, such as ethylene glycol monomethyl (or monoethyl) ether, diethylene glycol monomethyl (or monoethyl) ether and triethylene glycol monomethyl (or monoethyl) ether; lower dialkyl ethers of polyhydric alcohols, such as triethylene glycol dimethyl (or diethyl) ether and tetraethylene glycol dimethyl (or diethyl) ether; sulfolane; N-methyl-2-pyrrolidone; 2-pyrrolidone; and 1,3-dimethyl-2-imidazolidinone. The content of the water-soluble organic solvent is generally within the range of preferably from 0 to 50% by weight, more preferably from 2 to 45% by weight based on the total weight of the ink.

Such water-soluble organic solvents as described above may be used either singly or in any combination thereof if used in combination with water. However, the most preferable water-soluble organic solvent is such that at least one of monohydric, polyhydric alcohols and derivatives thereof is contained. Among others, thiodiglycol, bishydroxyethylsulfone, diethylene glycol, triethylene glycol, triethylene glycol monomethyl ether, tetraethylene glycol dimethyl ether and ethanol are particularly preferred.

The principal components of the inks used in the present invention are as described above. Besides, various kinds of dispersing agents, surfactants, viscosity modifiers, surface tension modifiers, optical whitening agents and the like may be added as needed.

The printing process of the present invention will hereinafter be described in detail.

In the present invention, the black and orange inks respectively containing the black and orange reactive dyes respectively having reactive groups different from each other are shot onto a cloth by an ink-jet system so as to overlap each other, thereby expressing a black color.

In order to enhance the effect of deepening the color, the application ratio of the black reactive dye to the orange reactive dye at the overlapped portion is controlled within the range of from 1:2 to 8:1, preferably from 1:1 to 6:1, more preferably from 3:2 to 3:1 in terms of a mass ratio of the black reactive dye to the orange reactive dye.

With respect to the application ratio of the black reactive dye to the orange reactive dye, the optimum value is delicately changed according to the type and condition of the cloth used. The most effective combination and ratio of the dyes are as follows: The black reactive dye is C.I. Reactive Black 5, the orange reactive dye is C.I. Reactive Orange 13, and the application ratio of C.I. Reactive Black 5 to C.I. Reactive Orange 13 is from 5:3 to 3:1 when textile printing is conducted on a cotton fabric. In this case, the expression closest to "complete black color" can be achieved. On the other hand, when textile printing is conducted on a silk fabric, "complete black color" can be expressed when the application ratio of C.I. Reactive Black 5 to C.I. Reactive Orange 13 is from 3:2 to 2:1. The reason why the application ratio is changed as described above is considered to be attributable to two reasons that the coloring yields of the respective reactive dyes vary between cotton and silk, and that the degrees of scattering of light on cotton and silk themselves are different from each other, and so the perception of a person is changed.

A cloth on which textile printing can be conducted according to the process of the present invention may be any cloth so far as it is dyeable with reactive dyes. However, examples of preferable cloths include cloths comprising cotton, silk, hemp and rayon fibers, respectively, and blended yarn cloths comprising at least two of these fibers.

The cloth used in the present invention as described above is preferably subjected to any conventionally-known pretreatment for the purpose of preventing bleeding between inks and enhancing color density. A preferable example of a method for the pretreatment includes a method in which at least one of a water-soluble polymer, urea, a water repellent and the like is contained in a cloth to be printed at a content of 0.1 to 20% by weight based on the weight of the cloth.

The water-soluble polymer is preferably a water-soluble resin having a viscosity average molecular weight of at least 100,000. Examples of such a water-soluble resin include polyethylene oxide resins, polyacrylate resins, poly(vinyl methyl ether) resins, polyvinyl alcohol resins, polyvinyl pyrrolidone resins and poly(diaryldimethylammonium chloride) resins.

It is preferable that paraffin wax and polyethylene wax be contained in combination as the water repellent in the cloth for the purpose of holding the dyes on the surface of the cloth to enhance the coloring properties of the dyes, providing a high-density image having excellent color evenness and high color depth and obtaining a print of a "complete black color". The content of the paraffin wax is within the range of preferably from 0.01 to 10% by weight, more preferably from 0.05 to 8% by weight, still more preferably from 0.1 to 5% by weight based on the cloth. The content of the polyethylene wax is within the range of preferably from 0.01 to 10% by weight, more preferably from 0.03 to 8% by weight, still more preferably from 0.05 to 5% by weight based on the cloth.

For the printing process of the present invention, the respective inks described above are applied to the cloth by an ink-jet system. The ink-jet system used in the present invention may be any conventionally-known ink-jet system. However, the method described in, for example, Japanese Patent Application Laid-Open No. 54-59936, in which thermal energy is applied to an ink so as to undergo rapid volume change, and the ink is ejected from a nozzle by action force caused by this change of state, is most effective.

The reason for it is that when a printing head equipped with a plurality of nozzles is used in the above-described system, the system has narrow variation in ejection velocities of the ink among individual nozzles, and the ejection velocities of the ink are concentrated within the range of from 5 to 20 m/sec. Such a velocity is a velocity in which the degree of penetration of ink droplets into the cloth when the ink containing the above-described reactive dye impacts the cloth with this velocity becomes optimum.

When the inks used in the present invention are used in such an ink-jet system, neither deposition of foreign matter on a heating head of a printing apparatus nor disconnection is caused even when printing is conducted continuously for a long period of time. Therefore, the printing can be conducted stably. As for conditions under which a particularly high effect can be achieved by such an ink-jet system, it is preferred that an ejected ink droplet be within the range of from 20 to 200 pl, a shot-in ink quantity be within the range of from 4 to 40 nl/mm$^2$, a drive frequency be at least 1.5 kHz, and a head temperature be within the range of from 35 to 60° C.

Figure 2:
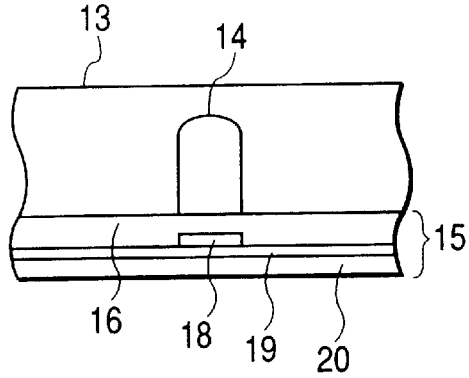
FIG. 2 is a transverse cross-sectional view of the head of the ink-jet printing apparatus along the line 2—2 of FIG. 1.
Figure 3:
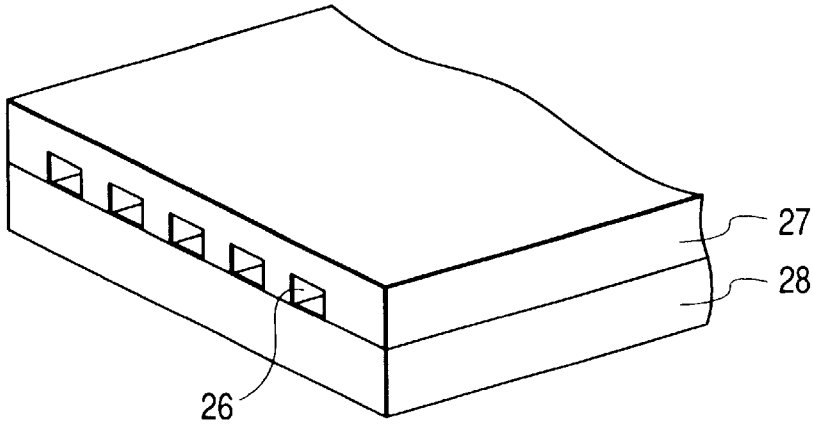
FIG. 3 is a perspective view of the appearance of a multi-head which is an array of such heads as shown in FIG. 1.

As an illustrative example of an ink-jet apparatus, which is suitable for use in applying the inks to a cloth in the printing process according to the present invention, may be mentioned an apparatus in which thermal energy corresponding to printing signals is applied to an ink within a recording head, and ink droplets are generated by the thermal energy. Such an apparatus will hereinafter be described. Examples of the construction of an head, which is a main component of such an apparatus, are illustrated in FIGS. 1, 2 and 3.

A head 13 is formed by bonding a glass, ceramic, plastic plate or the like having a groove 14 through which ink is passed, to a heating head 15 used in thermal recording (the drawings show a head to which, however, the invention is not limited). The heating head 15 is composed of a protective film 16 formed of silicon oxide or the like, aluminum electrodes 17-1 and 17-2, a heating resistor layer 18 formed of nichrome or the like, a heat accumulating layer 19, and a substrate 20 made of alumina or the like having a good heat radiating property. An ink 21 comes up to an ejection orifice (a minute opening) 22 and forms a meniscus 23 due to a pressure P.

Now, upon application of electric signals to the electrodes 17-1, 17-2, the heating head 15 rapidly generates heat at the region shown by n to form bubbles in the ink 21 which is in contact with this region. The meniscus 23 of the ink is projected by the action of the pressure thus produced, and the ink 21 is ejected from the ejection orifice 22 to a cloth 25 in the form of ink droplets 24. FIG. 3 illustrates an appearance of a multi-head composed of an array of a number of heads as shown in FIG. 1. The multi-head is formed by closely bonding a glass plate 27 having a number of grooves 26 to a heating head 28 similar to the heating head illustrated in FIG. 1. Incidentally, FIG. 1 is a cross-sectional view of the head taken along a flow path of the ink, and FIG. 2 is a cross-sectional view taken along line 2—2 in FIG. 1.

Figure 4:
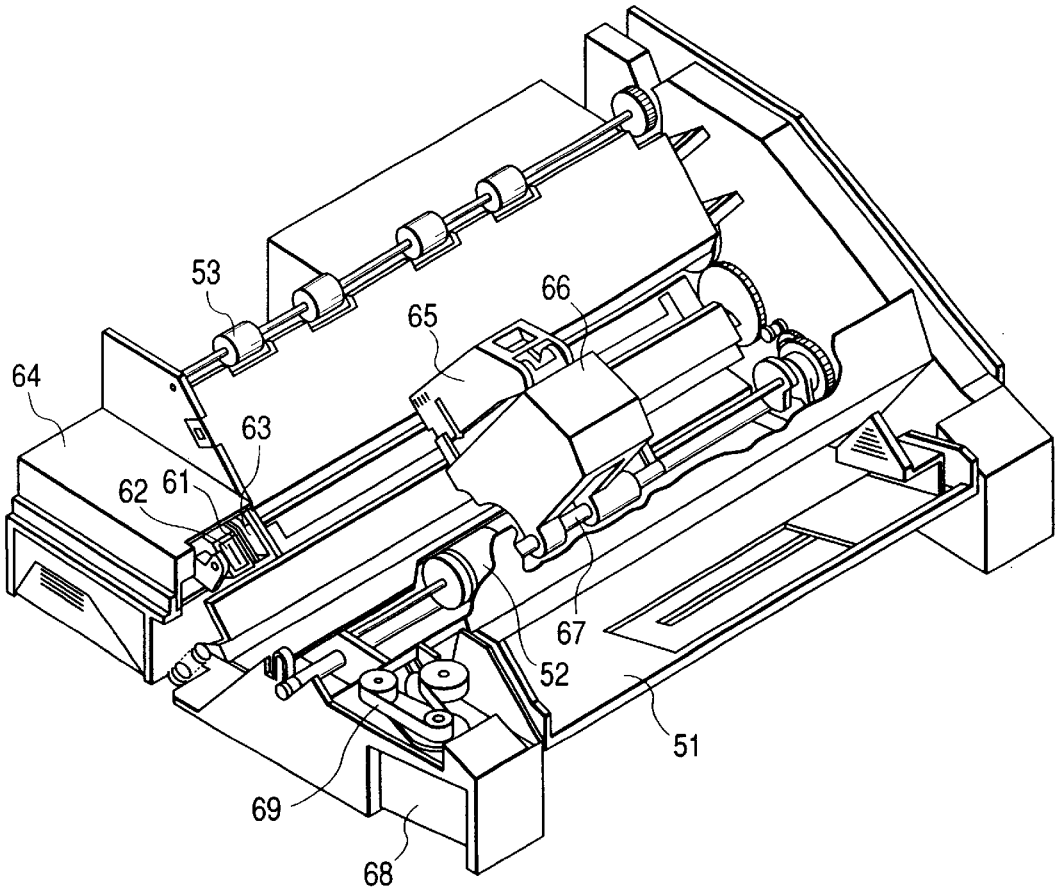
FIG. 4 is a perspective view illustrating an exemplary ink-jet printing apparatus.

FIG. 4 illustrates an example of an ink-jet printing apparatus in which the above head has been incorporated.

In FIG. 4, reference numeral 61 designates a blade serving as a wiping member, one end of which is a stationary end held by a blade-holding member to form a cantilever. The blade 61 is provided at the position adjacent to the region in which a printing head 65 operates, and in this embodiment, is held in such a form that it protrudes into the course through which the printing head 65 is moved. Reference numeral 62 indicates a cap, which is provided at the home position adjacent to the blade 61, and is so constituted that it moves in the direction perpendicular to the direction in which the printing head 65 is moved and comes into contact with the face of ejection openings to cap it. Reference numeral 63 denotes an absorbing member provided adjoiningly to the blade 61 and, similar to the blade 61, held in such a form that it protrudes into the course through which the printing head 65 is moved. The above-described blade 61, cap 62 and absorbing member 63 constitute an ejection-recovery portion 64, where the blade 61 and absorbing member 63 remove water, dust and/or the like from the face of the ink-ejecting openings.

Reference numeral 65 designates the printing head having an ejection-energy-generating means and serving to eject the ink onto the cloth set in an opposing relation to the ejection opening face provided with ejection openings to conduct printing. Reference numeral 66 indicates a carriage on which the printing head 65 is mounted so that the printing head 65 can be moved. The carriage 66 is slidably interlocked with a guide shaft 67 and is connected (not illustrated) at its part to a belt 69 driven by a motor 68. Thus, the carriage 66 can be moved along the guide shaft 67, and hence the printing head 65 can be moved from a printing region to a region adjacent thereto.

Reference numerals 51 and 52 denote a cloth feeding part from which cloths are separately inserted, and cloth feed rollers driven by a motor (not illustrated), respectively. With such a construction, the cloth is fed to the position opposite to the ejection opening face of the printing head 65, and discharged from a cloth discharge section provided with cloth discharge rollers 53 with the progress of printing.

In the above construction, the cap 62 in the head recovery portion 64 is receded from the path of motion of the printing head 65 when the printing head 65 is returned to its home position, for example, after completion of printing, and the blade 61 remains protruded into the path of motion. As a result, the ejection opening face of the printing head 65 is wiped. When the cap 62 comes into contact with the ejection opening face of the printing head 65 to cap it, the cap 62 is moved so as to protrude into the path of motion of the printing head 65.

When the printing head 65 is moved from its home position to the position at which printing is started, the cap 62 and the blade 61 are at the same positions as the positions for the wiping as described above. As a result, the ejection opening face of the printing head 65 is also wiped at the time of this movement.

The above movement of the printing head 65 to its home position is made not only when the printing is completed or the printing head 65 is recovered for ejection, but also when the printing head 65 is moved between printing regions for the purpose of printing, during which it is moved to the home position adjacent to each printing region at given intervals, where the ejection opening face is wiped in accordance with this movement.

Figure 5:
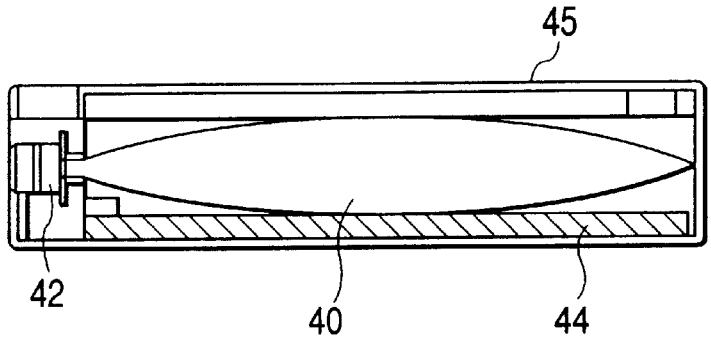
FIG. 5 is a longitudinal cross-sectional view of an ink cartridge.

FIG. 5 illustrates an exemplary ink cartridge in which an ink to be fed to the head through an ink-feeding member, for example, a tube is contained. Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head.

Reference numeral 44 indicates an ink-absorbing member for receiving a waste ink. It is preferable that the ink container portion be formed of a polyolefin, in particular, polyethylene, at its surface with which the ink comes into contact. The ink-jet printing apparatus used in the present invention are not limited to the apparatus as described above in which the head and the ink cartridge 45 are separately provided. Therefore, a device in which these members are integrally formed as shown in FIG. 6 can also be preferably used.

Figure 6:
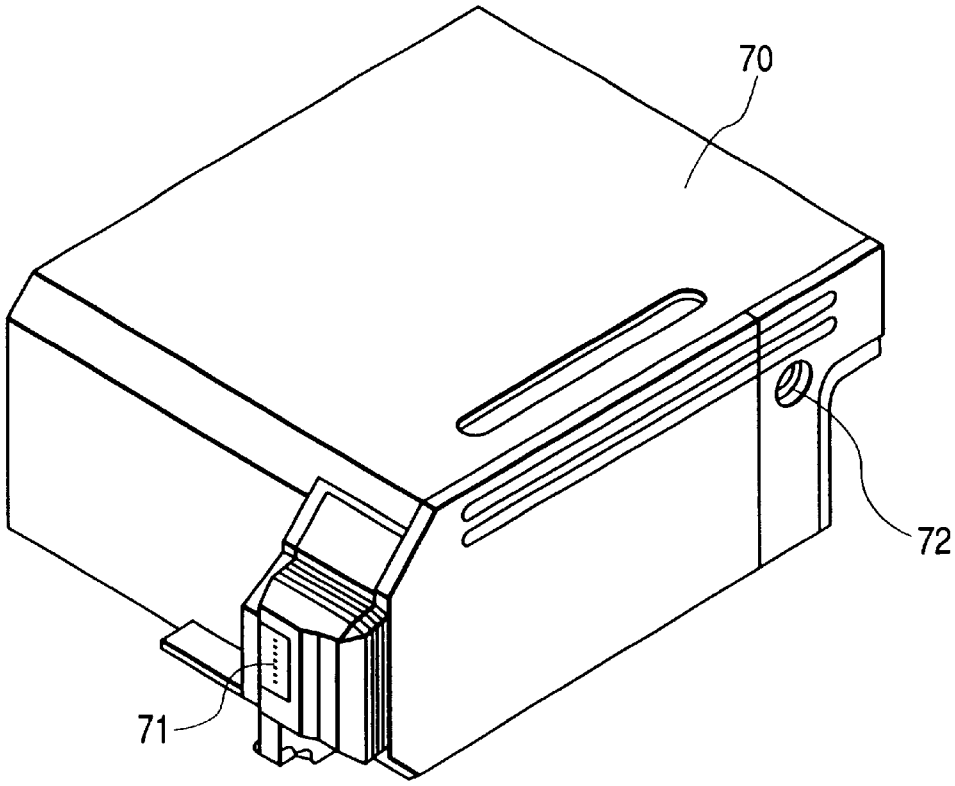
FIG. 6 is a perspective view illustrating an exemplary printing unit.

In FIG. 6, reference numeral 70 designates a printing unit, in the interior of which an ink container portion containing an ink, for example, an ink-absorbing member, is contained. The printing unit 70 is so constructed that the ink in such an ink-absorbing member is ejected in the form of ink droplets through a head 71 having a plurality of orifices. Polyurethane is preferably used as a material for the ink-absorbing member. Reference numeral 72 indicates an air passage for communicating the interior of the printing unit 70 with the atmosphere. This printing unit 70 can be used in place of the printing head 65 shown in FIG. 4, and is detachably installed on the carriage 66.

The printing inks are applied to the cloth by means of the ink-jet apparatus described above. However, the inks applied to the cloth only adhere to the cloth in this state. Accordingly, the cloth must be subsequently subjected to a step of reactively fixing the dyes to the fiber, and a step of removing unfixed dyes. Such reactively fixing step and the removing process of the unfixed dyes may be conducted in the following manner to markedly achieve the effect of the present invention. As the fixing process, a high-temperature steaming (HT steaming) process may preferably be used. In the case of the HT steaming process, the treatment may preferably be conducted under conditions of 95 to 130° C. and 2 to 30 minutes, more preferably under conditions of 100 to 120° C. and 4 to 10 minutes. With respect to the removing process of the unfixed dyes, it is only necessary to washing the cloth in accordance with the conventionally known method.

Inks of other hues are further used in combination with the above inks, whereby a full-color image can be obtained.

Incidentally, the cloth subjected to the step of reactively fixing the dyes and the step of removing the unfixed dyes as described above can be then cut out into pieces of desired sizes, and the cut pieces can be subjected to processes required to obtain final processed articles, such as sewing, bonding and/or welding, thereby obtaining clothes such as one-piece suits, dresses and neckties, and bed covers, sofa covers, handkerchiefs, curtains, etc. The processes for processing the printed cloth by sewing and/or the like to provide clothes and other daily needs may follow the processes described in a great number of publicly known books such as, for example, "Saishin Nitto Hosei Manual" (published by Seni Journal) and a monthly journal "Soen" (published by Bunka Shuppan Kyoku).

The present invention will hereinafter be described more specifically by the following examples. Incidentally, all designations of "part" or "parts" and "%" as will be used in the following examples mean part or parts by weight and % by weight unless expressly noted.

EXAMPLE 1

Preparation of Cloth (A)

A 100% silk fabric formed of silk yarn having an average diameter of 22 d composed of silk fiber having an average diameter of 3 d was immersed in an aqueous solution containing 2.0% of polyethylene oxide (Alkox E60, trade name; product of Meisei Chemical Works, Ltd.; viscosity average molecular weight: 100,000 to 1,200,000), 1.0% sodium citrate and 2% of urea, squeezed to a pickup of 80% and then dried, thereby providing Cloth (A).

Preparation of Ink (a):

| | |
|---|---|
| Reactive dye (C.I. Reactive Black 5) | 12 parts |
| Thiodiglycol | 23 parts |
| 1,2,6-Hexanetriol | 5 parts |
| Triethylene glycol dimethyl ether | 6 parts |
| Water | Balance. |

All the above components were mixed, and the resulting mixture was stirred for 2 hours and then filtered under pressure through a membrane filter having a pore size of 0.2 μm, thereby obtaining Ink (a).

Preparation of Ink (b):

| | |
|---|---|
| Reactive dye (C.I. Reactive Orange 13) | 10 parts |
| Thiodiglycol | 24 parts |
| Diethylene glycol | 6 parts |
| Tetraethylene glycol dimethyl ether | 5 parts |
| Water | Balance. |

All the above components were mixed, and the resulting mixture was stirred for 2 hours and then filtered under pressure through a membrane filter having a pore size of 0.2 μm, thereby obtaining Ink (a).

The Inks (a) and (b) obtained in the above-described manner were charged into an ink-jet color printer (BJC-820J, trade name, manufactured by Canon Inc.) to print a sample pattern of a mixed color of the two inks on the Cloth (A) under conditions of a total shot-in dye quantity of 225 ng/cm$^2$, an application ratio between the dyes in Ink (a) and Ink (b) of 1:1 or 2:1 and a shooting order of the inks controlled (Ink (a)→Ink (b) or Ink (b)→Ink (a)). The thus-obtained print samples were then subjected to a fixing treatment of the dyes in accordance with a high-temperature steaming process at 105° C. for 8 minutes. Thereafter, the samples were washed with water to evaluate the hue, chromaticity (L*, a* and b*) and color stability of the print thus obtained. The results thereof are shown in Table 1. As apparent from Table 1, it is understood that a print of an achromatic black color is provided, and a higher-density print of a "complete black color" is obtained when the application ratio between the dyes in Ink (a) and Ink (b) is 2:1. Even when the shooting order of the inks was changed, the color stability remained good.

EXAMPLE 2

A sample pattern was printed on Cloth (A) in the same manner as in EXAMPLE 1 except that the total shot-in dye quantity and the shot-in ratio between the dyes in Ink (a) and Ink (b) were changed to 175 ng/cm$^2$ and 5:3 or 3:1, respectively, as shown in Table 1. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 1. As apparent from Table 1, it is understood that a print of an achromatic black color is provided, and a higher-density print of a "complete black color" is obtained when the application ratio between the dyes in Ink (a) and Ink (b) is 5:3. Even when the shooting order of the inks was changed, the color stability remained good.

EXAMPLE 3

A sample pattern was printed on Cloth (A) in the same manner as in EXAMPLE 1 except that the total shot-in dye quantity and the shot-in ratio between the dyes in Ink (a) and Ink (b) were changed to 150 ng/cm$^2$ and 5:2 or 6:1, respectively, as shown in Table 1. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 1. As apparent from Table 1, it is understood that even when the shooting order of the inks is changed, the color stability remains good, and a print of an achromatic black color is provided.

EXAMPLE 4

Preparation of Ink (c):

| | |
|---|---|
| Reactive dye (C.I. Reactive Orange 5) | 15 parts |
| Thiodiglycol | 15 parts |
| Triethylene glycol monomethyl ether | 6 parts |
| Water | Balance. |

All the above components were mixed, and the resulting mixture was stirred for 2 hours and then filtered under pressure through a membrane filter having a pore size of 0.2 μm, thereby obtaining Ink (c).

The Inks (a) and (c) thus obtained were used to print a sample pattern on Cloth (A) in the same manner as in EXAMPLE 1 except that the total shot-in dye quantity and the application ratio between the dyes in Ink (a) and Ink (c) were changed to 225 ng/cm$^2$ and 2:1 or 7:5, respectively, as shown in Table 1. The thus-obtained print samples were then subjected to a fixing treatment-of the dyes in accordance with a high-temperature steaming process at 105° C. for 8 minutes. Thereafter, the samples were washed with water to conduct the same evaluation as in EXAMPLE 1. The results thereof are shown in Table 1. As apparent from Table 1, it is understood that a print of an achromatic black color is provided, and a higher-density print of a "complete black color" is obtained when the application ratio between the dyes in Ink (a) and Ink (b) is 2:1. Even when the shooting order of the inks was changed, the color stability remained good.

EXAMPLE 5

A sample pattern was printed on Cloth (A) in the same manner as in EXAMPLE 1 except that the total shot in dye quantity and the application ratio between the dyes in Ink (a) and Ink (c) were changed to 150 ng/cm$^2$ and 4:1 or 8:1, respectively, as shown in Table 1. The thus-obtained print samples were then subjected to a fixing treatment of the dyes in accordance with a high temperature steaming process at 105° C. for 8 minutes. Thereafter, the samples were washed with water to conduct the same evaluation as in EXAMPLE 1. The results thereof are shown in Table 1. As apparent from Table 1, it is understood that even when the shooting order of the inks is changed, the color stability remains good, and a print of an achromatic black color is provided.

EXAMPLE 6

Preparation of Pretreating Agent (a) for Cloth

Preparation of Aqueous Emulsion of Paraffin Wax:

Thirty parts of paraffin wax (molecular weight: 300 to 600), 2 parts of polyoxyethylene cetyl ether, 1 part of polyoxyethylene sorbitan palmitate and 67 parts of water were emulsified in accordance with a method known per se in the art to prepare an aqueous emulsion of paraffin wax.

Preparation of Aqueous Emulsion of Polyethylene Wax:

Thirty parts of polyethylene wax (molecular weight: 2,000 to 3,000), 2 parts of polyoxyethylene cetyl ether, 1 part of polyoxyethylene sorbitan palmitate and 67 parts of water were emulsified in accordance with a method known per se in the art to prepare an aqueous emulsion of polyethylene wax.

Three parts of the aqueous emulsion of paraffin wax, 2.0 parts of the aqueous emulsion of polyethylene wax, 15 parts of polyoxyethylene (n=25) stearyl ether, 5.0 parts of sodium bicarbonate and 75.0 parts of water were mixed, and the mixture was stirred for 3 hours at 50° C., thereby preparing Pretreating Agent (a) for cloth in the form of a solution.

Preparation of Cloth (B)

A plain weave cotton fabric having a thickness of 250 $\mu$m was immersed in Pretreating Agent (a) for cloth, squeezed to a pickup of 100% and then dried, thereby providing Cloth (B).

A sample pattern was printed on the thus-obtained Cloth (B) with Ink (a) and Ink (b) in the same manner as in EXAMPLE 1. The thus-obtained print samples were then i<in subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 2. As apparent from Table 2, it is understood that a print of an achromatic black color is provided, and a higher-density print of a "complete black color" is obtained when the application ratio between the dyes in Ink (a) and Ink (b) is 2:1. Even when the shooting order of the inks was changed, the color stability remained good.

EXAMPLE 7

A sample pattern was printed on Cloth (B) with Ink (a) and Ink (b) in the same manner as in EXAMPLE 2. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 2. As apparent from Table 2, it is understood that even when the shooting order of the inks is changed, the color stability remains good, and a print of a "complete black color" is provided.

EXAMPLE 8

A sample pattern was printed on Cloth (B) with Ink (a) and Ink (b) in the same member as in EXAMPLE 3. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 2. As apparent from Table 2, it is understood that a print of an achromatic black color is provided, and a higher-density print of a "complete black color" is obtained when the application ratio between the dyes in Ink (a) and Ink (b) is 5:2. Even when the shooting order of the inks was changed, the color stability remained good.

EXAMPLE 9

A sample pattern was printed on Cloth (B) with Ink (a) and Ink (c) in the same manner as in EXAMPLE 4. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 2. As apparent from Table 2, it is understood that a print of an achromatic black color is provided, and a higher-density print of a "complete black color" is obtained when the application ratio between the dyes in Ink (a) and Ink (b) is 2:1. Even when the shooting order of the inks was changed, the color stability remained good.

EXAMPLE 10

A sample pattern was printed on Cloth (B) with Ink (a) and Ink (c) in the same manner as in EXAMPLE 5. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 2. As apparent from Table 2, it is understood that even when the shooting order of the inks is changed, the color stability remains good, and a print of an achromatic black color is provided.

COMPARATIVE EXAMPLE 1

A sample pattern was printed on Cloth (A) in the same manner as in EXAMPLE 1 except that the total shot-in dye quantity and the application ratio between the dyes in Ink (a) and Ink (b) were changed to 100 ng/cm$^2$ and 1:0 or 1:3, respectively, as shown in Table 1. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 1. As apparent from Table 1, it is understood that the print having the application ratio between the dyes of 1:0 is shifted to a blue region compared with the prints; according to EXAMPLEs 1 to 10, and the print having the application ratio between the dyes of 1:3 has a high L* value and is shifted to a magenta region, resulting in a failure to provide a print of an achromatic black color. When the shot-in ratio between the dyes in Ink (a) and Ink (b) is controlled to 1:3, a difference in color density was made, whereby good color stability cannot be achieved.

COMPARATIVE EXAMPLE 2

A sample pattern was printed on Cloth (A) in the same manner as in EXAMPLE 1 except that the total shot-in dye quantity and the shot-in ratio between the dyes in Ink (a) and Ink (c) were changed to 150 ng/cm$^2$ and 1:0 or 12:1, respectively, as shown in Table 1. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 1. As apparent from Table 1, it is understood that both samples are deteriorated in hue, resulting in a failure to provide any print of an achromatic black color.

COMPARATIVE EXAMPLE 3

A sample pattern was printed on Cloth (B) with Ink (a) and Ink (b) in the same manner as in COMPARATIVE EXAMPLE 1. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 2. As apparent from Table 2, it is understood that both samples are deteriorated in hue, resulting in a failure to provide any print of an achromatic black color. When the shot-in ratio between the dyes in Ink (a) and Ink (b) was controlled to 1:3, a difference in color density was made, whereby good color stability cannot be achieved.

COMPARATIVE EXAMPLE 4

A sample pattern was printed on Cloth (B) with Ink (a) and Ink (c) in the same manner as in COMPARATIVE EXAMPLE 2. The thus-obtained print samples were then subjected to a fixing treatment of the dyes in accordance with a high-temperature steaming process at 105° C. for 8 minutes. Thereafter, the samples were washed with water to conduct the same evaluation as in EXAMPLE 1. The results thereof are shown in Table 2. As apparent from Table 2, it is understood that both samples are deteriorated in hue, resulting in a failure to provide any print of an achromatic black color.

TABLE 1

| | | Total shot-in dye quantity | Shooting ratio by weight of dyes | Hue | chromaticity *2 | | | Color stability |
|---|---|---|---|---|---|---|---|---|
| | | ng/cm$^2$ | black:orange | *1 | L* | a* | b* | *3 |
| Ex. 1 | (1) | 225 | 1:1 | B | 16.0 | 3.6 | −0.8 | A |
| | (2) | | 2:1 | A | 15.8 | 2.4 | −2.3 | A |
| Ex. 2 | (1) | 175 | 5:3 | A | 16.6 | 3.0 | −1.7 | A |
| | (2) | | 3:1 | B | 16.3 | 2.3 | −3.5 | A |
| Ex. 3 | (1) | 150 | 5:2 | B | 17.2 | 2.6 | −3.1 | A |
| | (2) | | 6:1 | B | 17.1 | 1.4 | −5.1 | A |
| Ex. 4 | (1) | 225 | 2:1 | A | 16.1 | 2.8 | −2.0 | A |
| | (2) | | 7:5 | B | 16.7 | 3.4 | −2.5 | A |
| Ex. 5 | (1) | 150 | 4:1 | B | 16.9 | 1.9 | −4.0 | A |
| | (2) | | 8:1 | B | 18.5 | 0.9 | −6.1 | A |
| Comp. Ex. 1 | (1) | 150 | 1:0 | C | 18.5 | −2.8 | −8.7 | Not evaluated |
| | (2) | | 1:3 | C | 19.1 | 9.5 | 5.4 | B |
| Comp. Ex. 2 | (1) | 150 | 1:0 | C | 17.4 | −3.1 | −8.4 | Not evaluated |
| | (2) | | 12:1 | C | 18.5 | −1.5 | −9.4 | A |

TABLE 2

| | | Total shot-in dye quantity | Shooting ratio by weight of dyes | Hue | chromaticity *2 | | | Color stability |
|---|---|---|---|---|---|---|---|---|
| | | ng/cm$^2$ | black:orange | *1 | L* | a* | b* | *3 |
| Ex. 6 | (1) | 225 | 1:1 | B | 17.5 | 3.7 | −1.6 | A |
| | (2) | | 2:1 | A | 17.2 | 2.6 | −2.9 | A |
| Ex. 7 | (1) | 175 | 5:3 | A | 18.0 | 3.0 | −2.5 | A |
| | (2) | | 3:1 | A | 17.9 | 2.5 | −3.0 | A |
| Ex. 8 | (1) | 150 | 5:2 | A | 17.6 | 2.8 | −3.0 | A |
| | (2) | | 6:1 | B | 18.7 | 1.5 | −6.0 | A |
| Ex. 9 | (1) | 225 | 2:1 | A | 18.4 | 3.0 | −2.8 | A |
| | (2) | | 7:5 | B | 17.8 | 3.4 | −2.1 | A |
| Ex. 10 | (1) | 150 | 4:1 | B | 18.9 | 2.0 | −4.6 | A |
| | (2) | | 8:1 | B | 19.5 | 1.2 | −7.5 | A |
| Comp. Ex. 3 | (1) | 150 | 1:0 | C | 20.1 | −3.1 | −9.8 | Not evaluated |
| | (2) | | 1:3 | C | 21.1 | 9.2 | 6.3 | B |
| Comp. Ex. 4 | (1) | 150 | 1:0 | C | 18.9 | −0.5 | −9.1 | Not evaluated |
| | (2) | | 12:1 | C | 20.2 | −0.6 | −9.6 | A |

*1: Evaluated in accordance with the following standard based on the measured value obtained in *2.

A: A hue having L* of at most 18, a of not lower than 0, but not higher than 3 and b* of not lower than −3, but not higher than 0 (a hue having L* of at most 18, a of not lower than 0, but not higher than 3 and b* of not lower than −3, but not higher than 0 is generally judged to be a high-density "complete black color");

B: A hue having L* of at most 20, a* of not lower than 0, but not higher than 4 and b* of not lower than −7.5, but not higher than 0; and C: A hue having L* of higher than 20, and a* or b* outside the above range.

*2: The L*/a*/b* of each print sample were measured by means of a spectrophotometer C-M 2022 manufactured by MINOLTA CAMERA CO. LTD.

*3: The shooting order of the inks was changed (black→orange, orange→black) to measure L* of each color patch, thereby judging the color stability from a difference between the L* values and evaluating it in accordance with the following standard.

A: A difference in L* is at most 0.5, and a difference by the shooting order is little; and B: A difference in L* is greater than 0.5, and a difference by the shooting order is great.

As described above, according to the printing process according to the present invention, there can be provided high-density prints of an achromatic black color, and stable images free of changes in color tone can be obtained even when the shooting order of inks is somewhat changed.

What is claimed is:

1. A textile printing process for coloring a cloth, the cloth comprising fibers dyeable with reactive dyes, the process comprising the steps of:

(a) choosing an application ratio of a black reactive dye contained in a black ink to an orange reactive dye contained in an orange ink for an overlapped portion of the black and orange inks according to one of a type of cloth and water content of the cloth, wherein the application ratio is within the range of from 1:2 to 8:1 in terms of weight ratio;

(b) applying the black ink containing the black reactive dye and the orange ink containing the orange reactive dye to the cloth using an ink-jet system so that the black ink and the orange ink at least partially overlap each other, wherein the black and orange reactive dyes have reactive groups different from each other;

(c) heating or steaming the cloth, to which the inks have been applied in step (b); and (d) washing the cloth resulting from step (c).

2. The textile printing process according to claim 1, wherein the black reactive dye has a vinylsulfone group as a reactive group, and the orange reactive dye has a monochlorotriazinyl group as a reactive group.

3. The textile printing process according to claim 2, wherein the black reactive dye is at least one reactive dye selected from the group consisting of C.I. Reactive Black 5, 14 and 31, and the orange reactive dye is at least one reactive dye selected from the group consisting of C.I. Reactive Orange 5, 12, 13 and 35.

4. The textile printing process according to claim 1, wherein step (c) comprises a high-temperature steaming (HT steaming) step.

5. The textile printing process according to claim 1, wherein the ink-jet system is a system in which an ink is ejected by utilizing thermal energy.

6. A printed cloth obtained in accordance with the textile printing process according to claim 1.

7. A processed article obtained by sewing, bonding or welding the printed cloth according to claim 6.

8. A processed article obtained by cutting the printed cloth according to claim 6 into pieces of desired sizes and sewing, bonding or welding at least one of the pieces.

9. The processed article according to claim 8, wherein the processing is sewing.

10. The textile printing process according to claim 3, wherein the black reactive dye is C.I. Reactive Black 5, the orange reactive dye is C.I. Reactive Orange 13, and the application ratio satisfies conditions (a) or (b):

(a) the application ratio of the black reactive dye to the orange reactive dye is from 5:3 to 3:1 when the cloth is made of a cotton fabric, (b) the application ratio of the black reactive dye to the orange reactive dye is from 3:2 and 2:1 when the cloth is made of a silk fabric.

* * * * *

UNITED STATES PATENT AND TRADEMARK OFFICE

CERTIFICATE OF CORRECTION

PATENT NO. : 6,723,137 B1
DATED : April 20, 2004
INVENTOR(S) : Shinichi Hakamada et al.

It is certified that error appears in the above-identified patent and that said Letters Patent is hereby corrected as shown below:

Column 2,
Line 64, “balck” should read -- black --.

Column 3,
Line 14, “a” should be deleted.

Column 4,
Line 13, “an” should read -- a --.

Column 9,
Line 6, “washing” should read -- wash --.

Column 11,
Line 7, “treatment-of” should read -- treatment of --.

Signed and Sealed this

Tenth Day of August, 2004

JON W. DUDAS
*Acting Director of the United States Patent and Trademark Office*